US007766615B2

(12) United States Patent
Spangler et al.

(10) Patent No.: US 7,766,615 B2
(45) Date of Patent: Aug. 3, 2010

(54) LOCAL INDENTED TRAILING EDGE HEAT TRANSFER DEVICES

(75) Inventors: Brandon W. Spangler, Vernon, CT (US); Dominic J. Mongillo, Jr., West Hartford, CT (US); Michael F. Blair, Manchester, CT (US)

(73) Assignee: United Technlogies Corporation, Hartford, CT (US)

( * ) Notice: Subject to any disclaimer, the term of this patent is extended or adjusted under 35 U.S.C. 154(b) by 759 days.

(21) Appl. No.: 11/708,738

(22) Filed: Feb. 21, 2007

(65) Prior Publication Data

US 2008/0199317 A1 Aug. 21, 2008

(51) Int. Cl.
*F01D 25/12* (2006.01)

(52) U.S. Cl. ..... 416/1; 416/97 R

(58) Field of Classification Search ..... 415/115; 416/97 R

See application file for complete search history.

(56) References Cited

U.S. PATENT DOCUMENTS

| | | | | |
|---|---|---|---|---|
| 6,422,819 | B1 * | 7/2002 | Tsai et al. | 416/97 R |
| 6,551,063 | B1 * | 4/2003 | Lee et al. | 416/97 R |
| 6,607,355 | B2 * | 8/2003 | Cunha et al. | 416/97 R |
| 7,575,414 | B2 * | 8/2009 | Lee | 415/115 |

* cited by examiner

*Primary Examiner*—Ninh H Nguyen
(74) *Attorney, Agent, or Firm*—Bachman & LaPointe, P.C.

(57) ABSTRACT

A turbine engine component has an airfoil portion having a pressure side and a suction side, a trailing edge discharge slot, and a suction side lip downstream of an exit of the trailing edge slot. The suction side lip is provided with negative features for increasing local heat transfer coefficient in the region of the suction side lip.

18 Claims, 3 Drawing Sheets

LOCAL INDENTED TRAILING EDGE HEAT TRANSFER DEVICES

U.S. GOVERNMENT RIGHTS

The invention was made with U.S. Government support under contract N00019-02-C-3003 awarded by the U.S. Navy. The U.S. Government has certain rights in the invention.

BACKGROUND (1) Field of the Invention

A turbine engine component having local indented trailing edge heat transfer devices and to a method for cooling a trailing edge of an airfoil portion of a turbine engine component are described.

(2) Prior Art

Increasing turbine efficiency requirements have been driving the diameter of the trailing edge of an airfoil portion of a turbine blade to be as small as possible. This, coupled with manufacturing tolerances, make it difficult to cool the suction side lip of the trailing edge. Much effort has been put in to try and reduce the cooling air heatup before it gets to the trailing edge. However, not much has been done to increase local heat transfer at the trailing edge because of geometric constraints.

U.S. Pat. No. 6,607,355 shows the usage of dimple features on a surface upstream of a slot discharge. However, this patent does not deal with the treatment of surfaces that are exposed to a combination of both coolant air and hotter gas path convective boundary conditions.

SUMMARY OF THE INVENTION

As described herein, a turbine engine component is provided which broadly comprises an airfoil portion having a pressure side and a suction side, a trailing edge discharge slot, a suction side lip downstream of an exit of said trailing edge slot, and means for increasing local heat transfer coefficient in the region of said suction side lip.

A method for cooling a trailing edge of an airfoil portion of a turbine engine component is provided. The method broadly comprises the steps of providing an airfoil portion having a pressure side, a suction side, a trailing edge slot, and a suction side lip downstream of an exit of the trailing edge slot, and forming a plurality of negative features in the suction side lip.

Other details of the local indented trailing edge heat transfer devices, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1B:
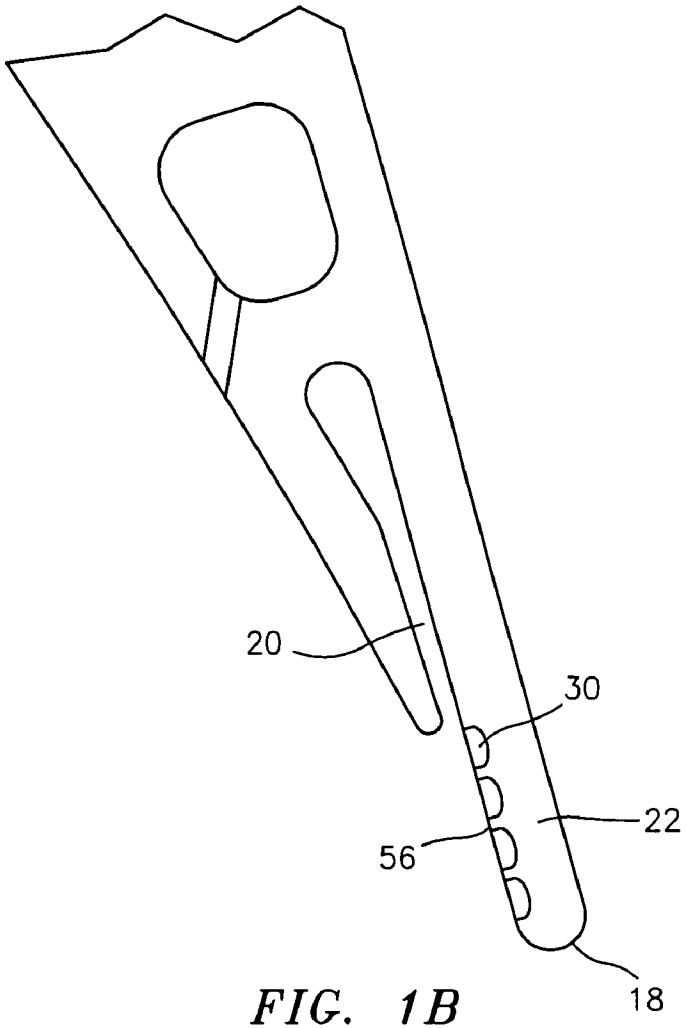
FIG. 1B is an enlarged view of the trailing edge portion of the airfoil portion of FIG. 1A.
Figure 1A:
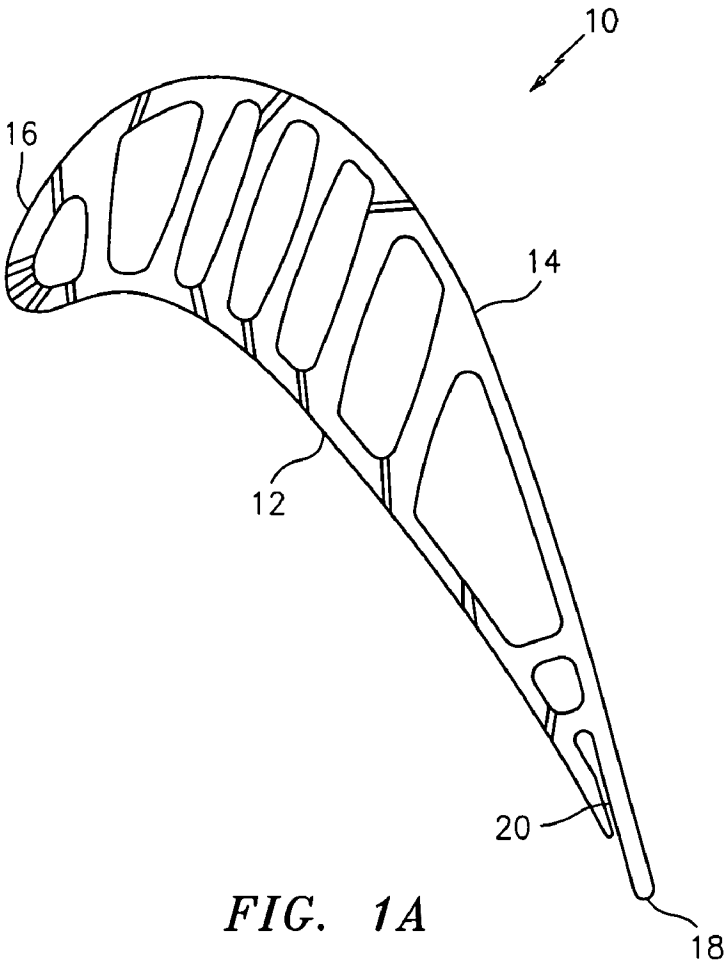
FIG. 1A is a sectional view of an airfoil portion of a turbine engine component.
Figure 2A:
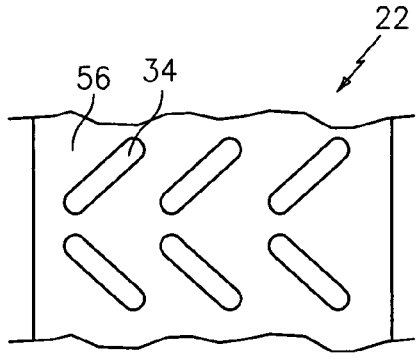
FIG. 2A illustrates a portion of a suction side lip having a plurality of indented segmented chevron strips.
Figure 2:
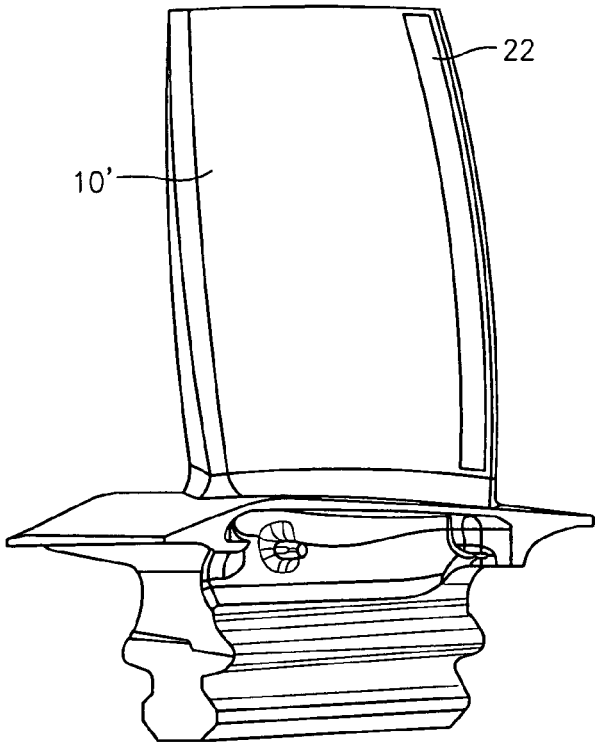
FIG. 2 illustrates an airfoil portion with a continuous suction side lip.

Referring now to the drawings, FIGS. 1A and 1B illustrate an airfoil portion 10 of a turbine engine component, such as a turbine blade or vane. The airfoil portion 10 has a pressure side 12, a suction side 14, a leading edge 16, and a trailing edge 18. The airfoil portion 10 has a trailing edge slot 20 which discharges cooling air over the trailing edge 18. The slot 20 may be supplied with the cooling air using any suitable system known in the art. FIG. 2 illustrates an airfoil portion 101 with a continuous suction side lip 22.

There is an exposed suction side lip 22 downstream of the slot 20 which is subjected to heat flux from external gas and/or attenuated film temperature from upstream suction side film. The wall 56 of the suction side lip 22 immediately downstream of the trailing edge slot 20 is exposed to a combination of both coolant air ejected from the trailing edge slot 20 and the attenuated film temperature from upstream pressure side film.

It is desirable to increase the local near wall turbulence within the boundary layer flow. The enhancement of the local heat transfer coefficient will increase the local cooling effectiveness of the trailing edge 18 and increase the local trailing edge oxidation capability. It is also desirable to increase the wetted surface area, thereby increasing the net heat rate removed from the local trailing edge surface.

Figure 2B:
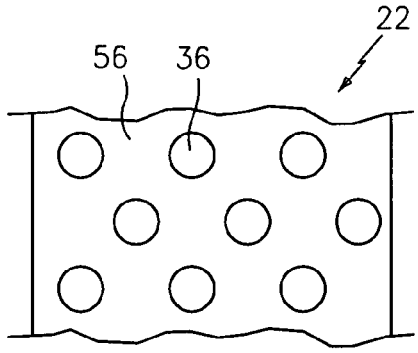
FIG. 2B illustrates a portion of a suction side lip having a plurality of loosely spaced dimples.
Figure 2C:
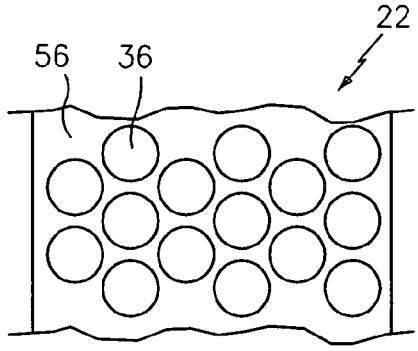
FIG. 2C illustrates a portion of a suction side lip having a plurality of closely spaced dimples.

To accomplish the foregoing, a plurality of indented regions or negative features 30 may be formed in the wall 56 of the suction side lip 22. The negative features 30, as shown in FIG. 2A, may take the form of a plurality of trip strips 34 such as segmented chevron strips. Alternatively, the negative features 30 may take the form of dimples 36. As shown in FIG. 2B, the dimples 36 may be arranged in a number of offset rows and loosely spaced. For example, the dimples 36 may be arranged in rows of one or two dimples. If desired, as shown in FIG. 2C, the dimples 36 may be tightly spaced and again placed in a number of offset rows. For example, the dimples 36 may be arranged in rows of two or three dimples.

The dimples 36 may be hemispherical, rectangular-shaped, or teardrop-shaped.

The size of the dimples 36 are controlled by the amount of available exposed surface area immediately downstream of the trailing edge slot 20.

The trip strips 34 and the dimples 36 may be features formed during casting or may be machined features.

The negative features 30 described herein enable cutback trailing edge designs to be integrated into higher temperature operating environments relative to current trailing edge cooling technologies. The negative features 30 described herein also help reduce the chances of axial crack propagation resulting from trailing edge oxidation and TMF. The negative features 30 increase heat transfer by increasing the surface area on wall 56 of the suction side lip 22 as well as the turbulence level of the cooling flow coming from the trailing edge slot 20. By placing these features in the suction side lip 22, the heat transfer is augmented as close to the distressed area as possible. The negative features 30 still allow the film cooling benefit of a pressure side cutback while also providing the heat transfer benefit that is gained by going to a center discharge trailing edge without having to increase the trailing edge diameter. The negative heat transfer features or indented regions have an advantage over positive heat transfer features in that many features can be placed close together without blocking the flow, which increases heat transfer. Moreover, there is little possibility of the surface of these features being scrubbed by hot gas as there would be with positive features.

Figure 3:
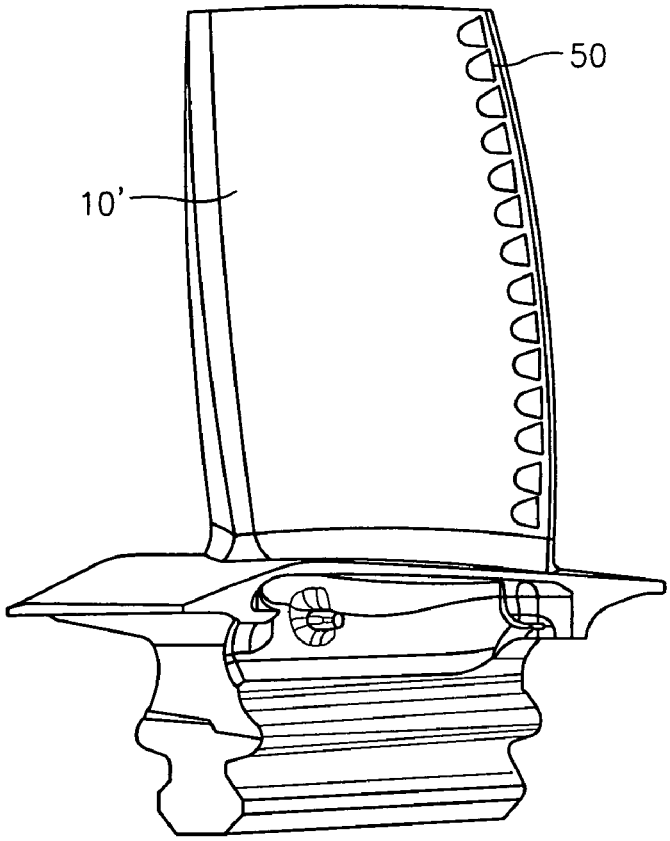
FIG. 3 illustrates a turbine blade having a plurality of trailing edge windows.
Figure 3A:
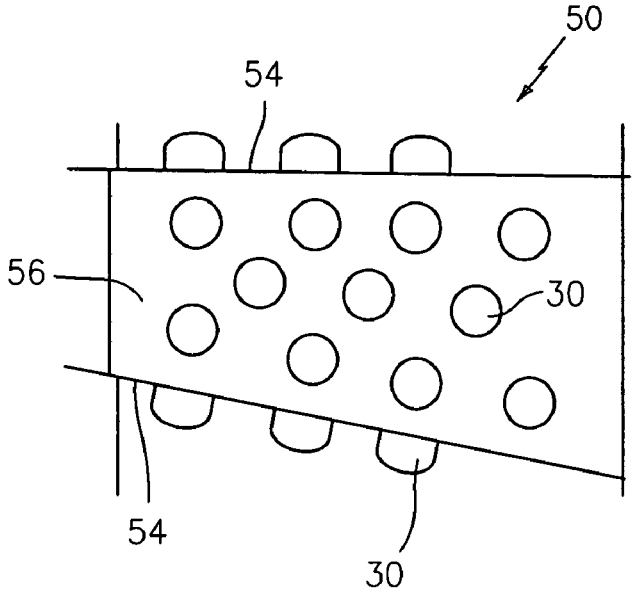
FIG. 3A illustrates a trailing edge window having indented heat transfer features on the sidewalls of the trailing edge window.

Referring now to FIG. 3, there is shown an airfoil portion $\mathbf{10}^1$ of a turbine engine component having a plurality of trailing edge windows 50. Referring now to FIG. 3A, there is shown an enlarged view of a trailing edge window having indented heat transfer features 30 on the sidewalls 54. If desired, indented heat transfer features 30 may also, or optionally, be placed on the backwall 56.

It is apparent that there has been provided local indented trailing edge heat transfer devices which fully satisfy the objects, means and advantages set forth hereinbefore. While the devices have been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A turbine engine component comprising:

an airfoil portion having a pressure side and a suction side;

a trailing edge discharge slot;

a suction side lip downstream of an exit of said trailing edge slot; and means for increasing local heat transfer coefficient in the region of said suction side lip.

2. The turbine engine component of claim 1, wherein said local heat transfer coefficient increasing means comprises a plurality of negative features in said suction side lip.

3. The turbine engine component of claim 2, wherein said negative features comprise a plurality of indented regions in said suction side lip.

4. The turbine engine component of claim 2, wherein each of said negative features comprises an indented trip strip.

5. The turbine engine component of claim 2, wherein said plurality of negative features comprises a plurality of segmented chevron strips.

6. The turbine engine component of claim 2, wherein said plurality of negative features comprises a plurality of dimples.

7. The turbine engine component of claim 6, wherein each said dimple has a hemispherical shape.

8. The turbine engine component of claim 6, wherein said plurality of dimples are arranged in a plurality of rows.

9. The turbine engine component of claim 8, wherein at least one dimple in each row is offset from a dimple in an adjacent row.

10. A method for cooling a trailing edge of an airfoil portion of a turbine engine component comprising the steps of:

providing an airfoil portion having a pressure side, a suction side, a trailing edge slot, and a suction side lip downstream of an exit of said trailing edge slot; and forming a plurality of negative features in said suction side lip.

11. The method of claim 10, wherein said negative features forming step comprises forming a plurality of indented trip strips in said suction side lip.

12. The method of claim 10, wherein said negative features forming step comprises forming a plurality of indented segmented chevron strips in said suction side lip.

13. The method of claim 10, wherein said negative features forming step comprises forming a plurality of indented dimples in said suction side lip.

14. The method of claim 10, wherein said negative features forming step comprises forming a plurality of indented hemispherically shaped dimples in said suction side lip.

15. A turbine engine component comprising:

an airfoil portion;

at least one trailing edge window in said airfoil portion; and each said trailing edge window having first and second opposed sidewalls and a plurality of negative features in each of said sidewalls.

16. The turbine engine component according to claim 15, wherein each said trailing edge window has a backwall and said backwall has a plurality of negative features.

17. The turbine engine component according to claim 15, wherein said airfoil portion has a plurality of trailing edge windows.

18. The turbine engine component according to claim 15, wherein each said negative feature comprises an indentation.

* * * * *